US006009858A

United States Patent [19]

Teerman

[11] Patent Number: 6,009,858

[45] Date of Patent: Jan. 4, 2000

[54] FUEL INJECTOR PUMP HAVING A VAPOR-PREVENTION ACCUMULATOR

[75] Inventor: Richard F. Teerman, Wyoming, Mich.

[73] Assignee: Diesel Technology Company, Kentwood, Mich.

[21] Appl. No.: 09/119,283

[22] Filed: Jul. 20, 1998

[51] Int. Cl.[7] ..... F02M 37/04

[52] U.S. Cl. ..... 123/506

[58] Field of Search ..... 123/506, 500–501; 417/505, 494

[56] References Cited

U.S. PATENT DOCUMENTS

| | | | |
|---|---|---|---|
| 5,357,944 | 10/1994 | Rathmayr | 123/506 |
| 5,478,213 | 12/1995 | Harris et al. | 123/506 |
| 5,749,717 | 5/1998 | Straub et al. | 123/506 |

*Primary Examiner*—Thomas N. Moulis
*Attorney, Agent, or Firm*—Bill C. Panagos

[57] ABSTRACT

A diesel fuel injector pump comprising a housing having a pump chamber; a piston movable in said pumping chamber to develop a pumping force; a fuel outlet passage communicating with said pumping chamber for delivering pressurized fuel to a fuel injector, a low pressure fuel inlet connected to said pumping chamber; a low pressure fuel return, injection timing means comprising a relief chamber, a control valve having a first position permitting flow from said pumping chamber to said relief chamber, and a second position allowing the entire pumping chamber output to be directed into said fuel outlet passage; a solenoid means for operating said control valve; said solenoid means comprising an armature and an armature chamber; a first accumulator passage connecting said relief chamber to said fuel return; and a second accumulator passage connecting said armature chamber to said fuel inlet.

11 Claims, 2 Drawing Sheets

FUEL INJECTOR PUMP HAVING A VAPOR-PREVENTION ACCUMULATOR

BACKGROUND AND SUMMARY OF THE INVENTION

This invention is related to a fuel injector pump for a diesel engine, and particularly to a fuel injector pump having an accumulator for preventing the formation of harmful fuel vapor in the pump passages.

The invention contemplates an anti-vapor improvement for an existing fuel injector pump. This pre-existing pump comprises a pump housing equipped with a solenoid-operated control valve for timing the flow of pressurized fuel to a fuel injector at an engine cylinder, whereby a desired quantity of fuel is injected into the cylinder at the desired point for efficient engine performance.

The fuel injector pump comprises a relief chamber connected to the pump fuel outlet passage, such that during the initial portion of the pumping stroke some, or all, of the pressurized fuel is directed into the relief chamber, rather than going to the fuel injector. Such fuel flows from the relief chamber to a fuel return means leading back to the fuel supply. At some point in the pumping stroke the solenoid operator for the control valve is energized to cause the valve to interrupt the connection between the fuel outlet passage and the relief chamber, such that pumping chamber output is directed into the fuel outlet passage leading to the associated fuel injector.

With the described pump, the quantity of fuel delivered to the fuel injector is determined by the duration of the electrical signal sent to the solenoid operator for the control valve. The timing of the injection is determined by the timing of the electrical signal.

As noted above, there is a period at the beginning of the pumping stroke when all, or most, of the pressurized fuel is diverted from the fuel outlet passage through the relief chamber to the fuel return means. The fuel return means is essentially at zero pressure, such that the pressurized fuel undergoes a substantial pressure drop as it flows from the outlet passage through the relief chamber; the fuel velocity is relatively high in the relief chamber. At the instant when the control valve interrupts the connection between the outlet passage and the relief chamber the fast-flowing fuel in the relief chamber tends to create a vacuum condition in the relief chamber by the inertia effect. The fuel tends to vaporize. Also a relatively large pressure spike can be generated at the control valve.

Vaporization of fuel can cause damage inside the pump by a phenomenon known as cavitation erosion. Large pressure spikes can contribute to fuel leakage failure.

The present invention is directed to a mechanism for preventing, or minimizing, the undesired fuel vaporization and pressure spikes. Under the present invention, a flow restrictor orifice is provided between the fuel relief chamber and the depressurized fuel return means (passage). The orifice materially slows fuel velocity through the relief chamber so that when the control valve interrupts the connection between the outlet passage and the relief chamber the inertia forces in the relief chamber are reduced to a point where there is essentially no vaporization of the fuel flowing through the relief chamber. The orifice similarly affects the short duration flow out of the control valve at the end of injection.

The restrictor orifice offers the further advantage of pressurizing the fuel in the relief chamber. While the control valve is in the process of closing the relief chamber the pressurized fuel in the relief chamber can absorb any pressure spike being generated in the outlet passage proximate to the valve opening. The pressurized relief chamber acts as an accumulator to absorb the pressure spike before it can develop to harmful proportions. The orifice protects the depressurized fuel return means from harmful pressure spikes.

The solenoid-operated control valve used on the injector pump includes a solenoid armature located in an armature cavity in the pump housing. The control valve poppet is connected to the armature by a slidable plunger that extends through the fuel outlet passage. During operation of the fuel injector some pressurized fuel can leak from the outlet passage into the armature cavity via the clearance between the valve plunger and its guideway. The armature cavity is connected to a low pressure fuel inlet passage in order to supply fuel to the pumping chamber.

The pressurized fuel flowing through the armature cavity can vaporize for essentially the same reasons as previously discussed in connection with flow through the relief chamber. Under the present invention, a second flow restrictor orifice is provided between the armature cavity and the low pressure inlet passage. This second flow restrictor orifice prevents undesired vaporization of any leakage fuel in the armature cavity.

Further features of the invention will be apparent from the attached drawing and description of an illustrative embodiment of the invention.

DETAILED DESCRIPTION OF A PREFERRED EMBODIMENT OF THE INVENTION

Figure 1:
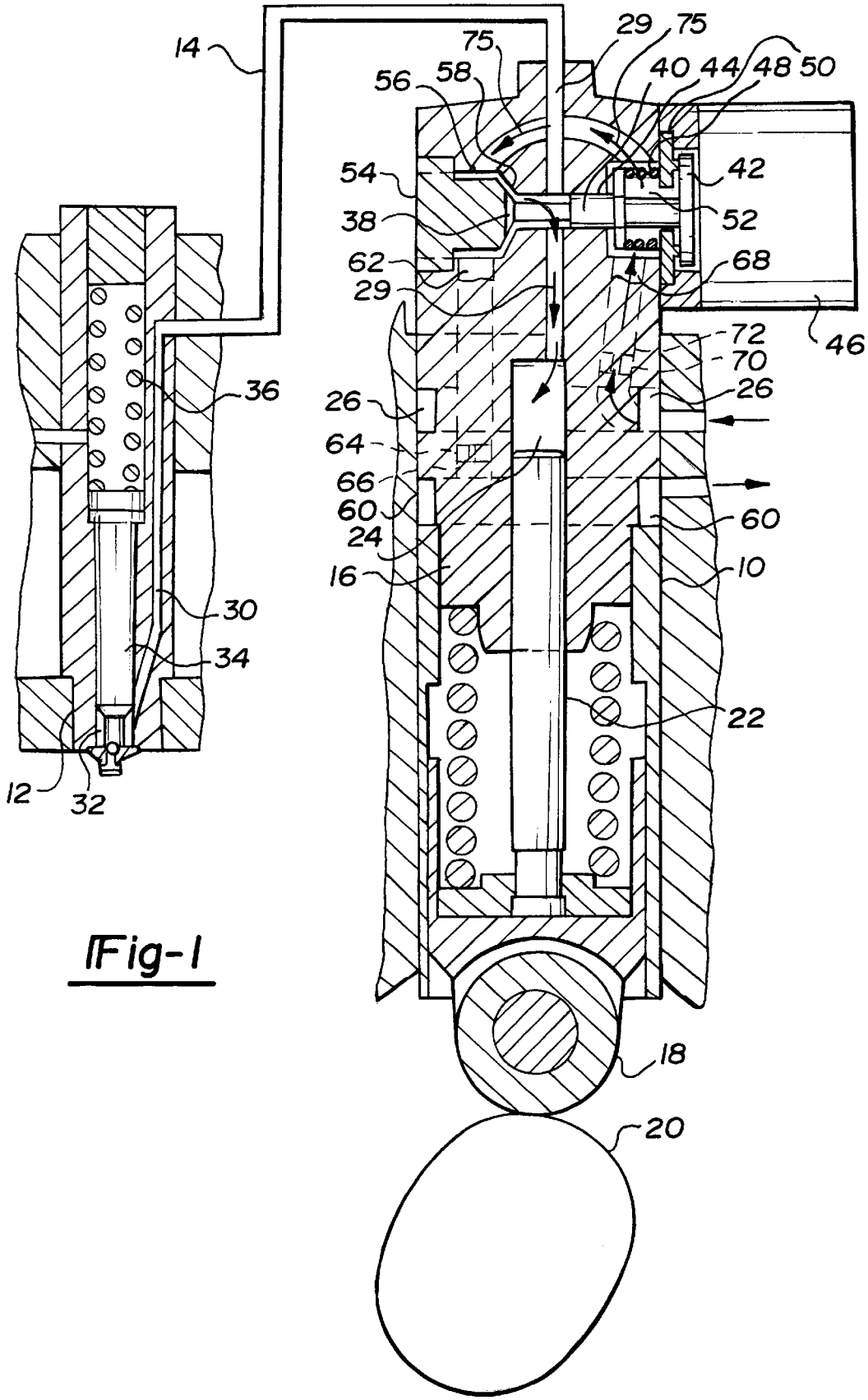
FIG. 1 is a sectional view taken through a fuel injector and fuel injector pump embodying the invention.

Turning now to the drawings, wherein like numeral depict like structures, and particularly to FIG. 1, there is shown therein a diesel fuel injector pump 10 of the present invention connected to a fuel injector 12 via a high pressure fuel line 14. The fuel injector pump 10 comprises a pump housing 16 suitably mounted in a bore in an engine so that roller 18 of the pump rides on a cam operator shaft 20, usually operating at one half engine speed.

Roller 18 is operably connected to a piston 22 that moves linearly back and forth in pumping chamber 24, as dictated by the cam operator 20 contour. Fuel at a relatively low pressure is supplied to pumping chamber 24 by a passage system 27 that includes an annular inlet chamber 26. The annular inlet chamber 26 is connected to passageway 27, which is in fluid communication with the armature cavity 52, which leads in turn to passageway 75. Passageway 75 is in fluid communication with relief chamber 56, which is further in fluid communication with passageway 29. As seen in the Drawing, piston 22 is shown at the bottom of the pumping stroke, preparatory to an upward motion for pumping and pressurizing the fuel in an outlet passage 29. When the solenoid valve is opened, fuel is allowed to pass through passage system 27, through the armature cavity 52 and into passageway 75, and thence to chamber 24. When the solenoid is closed, poppet element 38 is seated against surface 58, and passageway 29 is in fluid communication with fuel passage 14, and fuel may be forced at high pressure through the passage 14 by movement of the piston 22.

Passage 29 delivers pressurized fuel through line 14 to a passage 30 in fuel injector 12. Passage 30 communicates with an annular chamber 32 surrounding the tip end of a needle valve 34. When chamber 32 is pressurized to exert a force on the shoulder of needle valve 34 greater than the opposing force of spring 36 the needle valve opens to permit pressurized fuel to spray into the associated engine cylinder. When the pressure in chamber 32 drops below a value necessary to exert a force on valve 34 greater than the force of spring 36 the needle valve closes. In the illustrated system the end of injection (needle valve closure) occurs when solenoid means 46 opens.

The start of fuel injection is controlled by a solenoid valve means mounted in fuel injector pump 10. As shown in the drawing, the solenoid valve means comprises a poppet valve element 38 connected to a plunger 40 that extends from a disk-type armature 42. Plunger 40 is slidably mounted in a cylindrical guideway 44 drilled through pump housing 16 so as to intersect outlet passage 29.

An electrical solenoid means 46 is mounted on pump housing 16 so that when the solenoid is electrically energized armature 42 is drawn rightwardly from its illustrated position against the opposing force of a return spring 48. As shown in the drawing, spring 48 is trained between a fixed plate 50 attached to pump housing 16 and a flange on plunger 40, such that the plunger is normally biased leftwardly to retain poppet valve element 38 in its illustrated position. The spring 48, plate 50 and armature 42 are located within an armature cavity 52 that communicates with guideway 44.

As shown in the drawing, poppet element 38 seats against the flat end surface of a plug 54 that is suitably mounted in a cavity formed in the pump housing. The cylindrical side surface of plug 54 is spaced radially inwardly from the cavity side surface to form an annular relief chamber 56. Poppet valve element 38 has a frustro-conical surface that is aligned with a frustro-conical end surface 58 of chamber 56.

When solenoid means 46 is electrically energized, plunger 40 is moved rightwardly to cause poppet valve element 38 to engage frustro-conical end surface 58 of relief chamber 56, thereby interrupting the fluid connection between pump outlet passage 29 and relief chamber 56. This action initiates the fuel injection process at fuel injector 12, since the output of pumping chamber 24 is then directed through outlet passage 29 to the fuel injector until the solenoid means 46 is de-energized.

The pump housing has an annular low pressure return passage 60 that connects to pressure relief chamber 56 via a drilled passage 62. A plug 64 containing a flow restrictor orifice 66 is positioned in drilled passage 62, preferably near the end of passage 62 proximate to annular return passage 60. Orifice 66 constitutes an important feature of the invention, as will hereinafter be explained.

A second drilled passage 68 connects armature cavity 52 to the annular low pressure inlet 26. A second plug 70 having a flow restrictor orifice 72 of a predetermined diameter is positioned in passage 68.

The diameters for orifices 66 and 72 are determined in accordance with the flow restrictor effects necessary to prevent vaporization of the fuel in the respective chambers 56 and 52. In one operative arrangement the orifice diameters were 2.3 millimeters for orifice 72 and 1.2 millimeters for orifice 66.

A third drill passage 75 communicates chamber 52 to chamber 56. As noted previously, the timing of the electrical signal to solenoid means 46 determines the start of the injection action in fuel injector 12. At the start of the pumping stroke of piston 22 solenoid means 46 is in a de-energized condition, such that at least some of the fuel output from chamber 24 is directed into relief chamber 56. Line 14 is pressurized, but not sufficiently to open needle valve 34.

Pump chamber 24 output is directed through the open poppet valve element 38 into the relief chamber 56. Flow restrictor orifices 66 and 72 limit the flow rate through chamber 56 so that the pressure in chamber 56 is approximately the same as the pressure in outlet passage 29.

At a predetermined time in the pumping cycle solenoid means 46 is electrically energized to move poppet element 38 to a closed position against end surface of relief chamber 56. The entire output of pumping chamber 24 is directed into outlet passage 29, such that the pressure in injector chamber 32 is rapidly elevated to a value sufficient to start the fuel injection process. The injection process continues until solenoid 46 de-energizes.

The timing of the electrical signal to solenoid means 46 determines the beginning of fuel injected into the combustion cylinder. The fuel quantity which is injected is determined by Pulse Width delivered to the solenoid.

Flow restrictor orifice 66 is an important feature of the invention. When orifice 66 is used, the linear flow rate through chamber 56 is substantially reduced. At the moment of valve closure against 58 the orifice limits the effect of inertia, such that the fuel in chamber 56 is maintained at a reasonably high pressure, sufficient to minimize vaporization.

The high liquid pressure in chamber 56 at the moment of valve closure against surface 58 is also advantageous in that the liquid in chamber 56 acts as an accumulator to limit, or reduce, pressure spikes that might otherwise occur in outlet passage 29. As valve element 38 begins to close against surface 58 the throttling action raises the pressure on the upstream face of element 38. Fuel in outlet passage 29 rebounds from the pressurized fuel in chamber 56 to counteract any pressure spike that might otherwise be generated in passage 29. Before valve element 38 closure the pumping pressure is essentially directed toward chamber 56. After valve element 38 closure the pumping pressure is directed away from chamber 56 along outlet passage 29. The pressurized condition of chamber 56 provides a relatively gradual transition between the two conditions. Chamber 56, chamber 52 and all other internal fuel volume between the two restrictor orifices as an accumulator to minimize pressure spikes and store energy used later to help refill chamber 24 and line 14.

The second flow restrictor orifice 72 exerts an anti-vaporization effect on the backflow during pre-spill and post-spill. As fuel moves through passage 75 into cavity 52, orifice 72 limits the depressurization effect such that the pressure in cavity 52 remains at a value high enough to prevent vaporization in the cavity.

Figure 2:
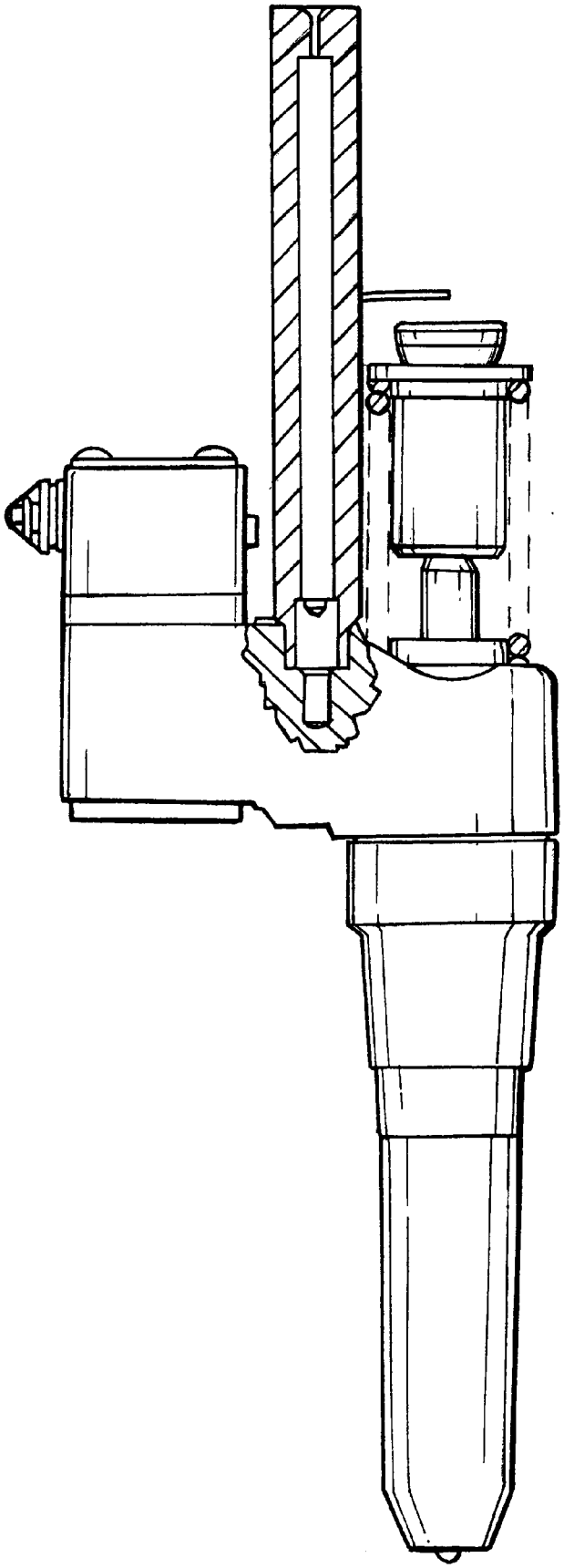
FIG. 2 is a side view of an electronic unit pump embodying the invention.

Turning to FIG. 2, there is shown therein an electronic unit pump which may also embody the present invention. Those skilled in the art will recognize that details of the invention which affect the internal structure of an electronic unit pump will be similar to those described with regard to the unit injector of FIG. 1.

The drawings show specific restrictor configurations for maintaining satisfactory pressure values in chamber 56 and cavity 52. However, it will be appreciated that other flow restrictor and volume arrangements can be used without departing from the scope and spirit of the invention as set forth in the attached claims.

What is claimed:

1. A diesel fuel injector pump, comprising: a housing having a pump chamber; a piston movable in said pumping chamber to develop a pumping force; a fuel outlet passage communicating with said pumping chamber for delivering pressurized fuel to a fuel injector; a low pressure fuel inlet connected to said pumping chamber; a low pressure fuel return, injection timing means comprising a relief chamber, a control valve having a first position permitting flow from said pumping chamber to said relief chamber, and a second position allowing the entire pumping chamber output to be directed into said fuel outlet passage; a solenoid means for operating said control valve; said solenoid means comprising an armature and an armature chamber; a first accumulator passage connecting said relief chamber to said fuel return; and a second accumulator passage connecting said armature chamber to said fuel inlet.

2. The fuel injector pump of claim 1, wherein each said accumulator passage has an inlet end and an outlet end; and a restrictor orifice means in each said accumulator passage proximate to the respective fuel connection end.

3. The fuel injector pump of claim 2, wherein each said accumulator passage is a drilled passage.

4. The fuel injector pump of claim 3, wherein each said orifice means comprises a plug positioned in an associated drilled passage; each said plug having an orifice therein of a predetermined diameter.

5. The fuel injector pump of claim l, wherein said control valve comprises a poppet valve element and a plunger connecting said valve element to said armature.

6. The fuel injector pump of claim 5, and further comprising a guideway for said plunger extending between said relief chamber and said armature chamber.

7. The fuel injector pump of claim 6, wherein said guideway intersects said fuel outlet passage.

8. A diesel engine fuel injector pump, comprising: a pump housing having a fuel pumping chamber; a piston movable linearly in said pumping chamber to develop a fuel pumping force; a fuel outlet passage communicating with said pumping chamber for delivering pressurized fuel to a fuel injector; a low pressure fuel inlet connected to said pumping chamber for supplying fuel to said chamber; a low pressure fuel return means; an injection timing means comprising a relief chamber communicating with said fuel outlet passage, a control valve having a first position permitting flow from said pumping chamber into said fuel outlet passage and said relief chamber, and a second position directing the entire pumping chamber output into said fuel outlet passage and said relief chamber, and a second position directing the entire pumping chamber output into said fuel outlet passage; solenoid means mounted on said pump housing for operating said control valve; an accumulator passage connecting said relief chamber to said fuel return means; and a restrictor orifice restricting fuel flow from said accumulator passage to said fuel return means.

9. The fuel injector pump of claim 8, wherein said restrictor orifice comprises a plug positioned in said accumulator passage and a hole of predetermined diameter in said plug.

10. The fuel injector pump of claim 8, wherein said pump housing has a guideway extending from said relief chamber transversely through said fuel outlet passage; said control valve comprising a poppet valve element within said relief chamber and a plunger slidably positioned in said guideway.

11. The fuel injector of claim 1, further including a restrictor orifice with a predetermined internal diameter and entry radius on one end of the diameter, which is placed in the inlet and return fuel lines of the injector to maintain pressure within the unit pump by restricting fuel flow from the unit injector through the fuel lines during a spill spike.

* * * * *